United States Patent [19]

Stahlecker

[11] Patent Number: 4,785,618

[45] Date of Patent: Nov. 22, 1988

[54] METHOD FOR OPERATING AN OPEN-END FRICTION SPINNING MACHINE

[75] Inventor: Fritz Stahlecker, Bad Überkingen, Fed. Rep. of Germany

[73] Assignees: Hans Stahlecker; Fritz Stahlecker, both of Fed. Rep. of Germany

[21] Appl. No.: 5,074

[22] Filed: Jan. 20, 1987

[30] Foreign Application Priority Data

Jan. 18, 1986 [DE] Fed. Rep. of Germany ..... 3601358

[51] Int. Cl.[4] ..... D01H 7/885; D01H 13/26

[52] U.S. Cl. ..... 57/264; 57/301; 57/401

[58] Field of Search ..... 57/264, 301, 304, 401, 57/263

[56] References Cited

U.S. PATENT DOCUMENTS 4,084,398 4/1978 Stahlecker et al. ..... 57/264 X
4,584,875 4/1986 Woo et al. ..... 57/264 X
4,592,198 6/1986 Stahlecker ..... 57/401
4,601,166 7/1986 Raasch ..... 57/401

FOREIGN PATENT DOCUMENTS 3342481 6/1985 Fed. Rep. of Germany .
3428509 2/1986 Fed. Rep. of Germany ..... 57/401

*Primary Examiner*—Stuart S. Levy
*Assistant Examiner*—Joseph J. Hail, III
*Attorney, Agent, or Firm*—Barnes & Thornburg

[57] ABSTRACT

A process for operating an open-end friction spinning machine is provided in which the spinning units each have at least two friction areas that form a yarn-forming region. At least a part of the friction effect is determined separately for each friction surface. The friction effect is compared between such friction surfaces. A corresponding open-end friction spinning machine apparatus is also provided.

16 Claims, 6 Drawing Sheets

METHOD FOR OPERATING AN OPEN-END FRICTION SPINNING MACHINE

BACKGROUND AND SUMMARY OF THE INVENTION

The invention relates to a process for operating an open-end friction spinning machine having a plurality of spinning units that each comprise a friction zone formed by two friction surfaces moving in opposite directions that is used as a yarn forming point. Each spinning unit also includes a feeding and opening device for the feeding of fibers to the friction zone, a suction device for holding the fibers and the forming yarn in the friction zone and a withdrawal device for withdrawing the yarn from the friction zone. The respective existing friction effect is monitored.

In a known process shown in DE-OS No. 33 42 481, the friction effect at each individual spinning unit, as well as between the respective spinning units with respect to one another, is kept as equal as possible so that a yarn is spun of a quality that is as uniform as possible. The friction effect significantly influences the quality of the spun yarn. Changes of this friction effect, essentially the coefficient of friction of the friction surfaces and the air current generated by the suction device, results immediately in a change of the quality and structure of the yarn. By examination of the friction effect, it is therefore endeavored to recognize changes in time and, if necessary, take appropriate measures so that a yarn quality can be achieved that is as uniform as possible.

One object of the invention is to provide a process of the initially mentioned type in which an informative monitoring of the friction effect is achieved as simply as possible.

This object is achieved by determining at least a part of the friction effect separately for the two friction surfaces of one spinning unit and comparing this effect between surfaces.

The invention is based on the recognition that it is sufficient for an informative monitoring to determine a change in the ratio of the friction effects of the two friction surfaces without the requirement of an exact measurement of the friction effect that refers to a basic quantity. As a result, it is possible to considerably reduce the equipment required for determining the friction effect, particularly with respect to forces to be applied and/or precisions to be observed when measuring devices are applied. The invention is also based on the recognition that, on the one hand, it cannot be expected that the friction effects will change in an identical way at both friction surfaces, and an inadmissible change of the ratio is a clear indication of an inadmissible change of the overall friction effect. On the other hand, it can be assumed that should the friction effects change in an identical way, this would only have a minor effect on the quality of the spun yarn, as long as a certain limit is not exceeded.

In the case of a further development of the invention, it is provided that the two friction surfaces, at least over a part of the length of the friction zone, are designed for different friction effects. In an advantageous further development, it is provided in this case that the friction surfaces form wedge-shaped gap type friction zone and that the friction surface that moves out of the wedge-shaped gap, at least over a part of the length of the wedge-shaped gap, is designed for a friction effect that is increased with respect to the other friction surface.

This different design of the friction effect is naturally taken into account during the monitoring. In practice, it was found that the differences in the friction effects of the friction surfaces should be between 5% and 25%, in which case an optimum is in the range of 15%. Since the friction effects are composed of the coefficient of friction of the surfaces of the friction areas and of the force of the air flow generated by the suction device, the coefficient of friction of the surfaces of the friction areas and/or the amount of the air flow can be designed correspondingly. As a rule, it is advisable to construct the surfaces of the friction areas with a different coefficient of friction and to consider the apportioning of the air flow only as a correction and an adjustment.

In a further development of the invention, it is provided that the friction effect existing in circumferential direction of the forming yarn and the friction effect existing in withdrawal direction of the forming yarn are determined. The friction effect acting in circumferential direction of the forming yarn is essentially responsible for the yarn twist, whereas the friction effect existing in withdrawal direction of the forming yarn is largely responsible for the tension of the yarn. Both values may be indicators of the spinning stability of a spinning unit.

In a further development of the invention, it is provided that a part of the friction effect is determined by an examination of the surface structure of the friction areas. This examination of the surface structure supplies information on any change of the coefficient of friction of the friction areas on the basis of a change of the surface structure. This examination of the surface structure may be carried out by means of optical sensors or picture recognition systems that offer the advantage of a non-contact examination.

In a further development of the invention, it is provided that a part of the friction effect is determined by an examination of the coefficient of friction at the surfaces of the friction areas. In this case, it may, for example, be provided that a measuring element in the form of a measuring string, a measuring yarn, a strip of woven fabric or knitted fabric, or the like is guided over the surface of the friction areas. In this embodiment, the measuring element is held in such a way that the take-along force which is applied to this measuring element because of the friction can be measured. In this case, it is advantageous to provide this measuring element in the form of a spool or of a reserve receptacle so that for each of the measurements, an unused part of the measuring element is available that has not been changed by preceding measurements.

In a further development of the invention, it is provided that a part of the friction effect is determined by examining the suction effect of the suction device. In the case of this development, a probe is brought into the range of the two friction areas by means of which a measurement is carried out of the vacuum and/or of the amount of air flowing in the range of the two friction areas.

In a further development of the invention, it is provided that the friction effect is determined by examining the spun yarn. This examination has the advantage that it can be carried out during the uninterrupted spinning process. Therefore, a conclusion can be drawn to the friction effect from the changes of the yarn diameter and/or the yarn structure. For example, in the case of a change of the diameter of the yarn, a conclusion can be drawn on the provided twist, which is dependent on the friction effect. In this case, however, the proportion of the friction effect of both friction areas is not detected. Therefore, it is advantageous to use this determination of the friction effect by examining the yarn in combination with and subsequent to one of the other types of determinations when a change is determined by examining the yarn.

In a further development of the invention, it is provided that the friction effects are determined by a device that can be moved along the spinning machine and that can be applied to the individual spinning units. This type of movable device has the advantage that only one monitoring device for determining the friction effect or parts of the friction effect is required. Therefore, individual monitoring devices do not have to be provided at each spinning unit. Obviously, individual monitoring devices can be provided at each spinning unit, but usually results in higher expenditures. Since only the relative changes of the friction effect between the two friction areas are determined, the requirements concerning the precision of the elements of the movable device, and especially with respect to its adjustment, are not too high because these can be applied without difficulty in such a way that they can be brought into the range of both friction areas with sufficient precision.

In the case of a further simple embodiment of the invention, it is provided that the determined values are displayed in a way that can be recognized by an operator. Advantageously, these values are stored and can be retrieved by the operator. The operator will then have to decide whether corrections must be carried out at the spinning units.

In a further development of the invention, it is provided that at least a part of the friction effect of the friction areas is corrected by an automatically operating device when a determined deviation exceeds a permissible value. The correction is a function of this deviation. Thus a correction will no longer depend on the attention, the care and the skill of the operator.

In a further development of the invention, it is provided that the correcting of the friction effect is carried out by treating at least one friction area. This type of treatment may, for example, include a changing of the surface by grinding, brushing or grinding with emery paper, or the like. It is also possible to provide a pneumatic-mechanical treatment during which small particles of sand or glass are thrown against the friction areas by means of an air flow. A device to be used for this purpose must naturally, by means of baffle plates or the like, be developed in such a way that the particles thrown back from the surfaces of the friction areas are collected and removed. The treatment of the surfaces of the friction areas may also be carried out by means of a fluid containing solid components. In addition, it is possible to treat the surfaces by chemical means that are applied in powder, liquid or paste form and are subsequently wiped off by means of a cleaning roller or the like. With this type of treatment, a cleaning and/or etching, and roughening of the surfaces can take place.

For the after-treatment of the friction areas, an electric eroding may also be provided. In addition, it is possible to dust the surfaces of the friction areas with a powder that completely or partially adheres to the surfaces, and thereby close the pores or furrows or the like of these surfaces, which affects the coefficient of friction. As a treatment, a washing-off of the friction areas may also be carried out to remove any deposits on the surfaces which were deposited during the spinning. This washing-off, which removes cotton wax or the like, for example, is advantageously combined with a mechanical brushing-off and a subsequent drying. In addition, it is possible to change the coefficient of friction corresponding to the determined deviations, by means of a heat treatment of the surfaces of the friction areas. Naturally, it is also possible without difficulty to combine one or several of the above-described types of treatment with one another.

In a further development of the invention, it is provided that the correcting is carried out by the adjusting of a spinning parameter influencing the friction effect. In this development, it is provided that for the correcting, the suction effect of the suction device onto at least one friction surface is changed. This type of correction has the advantage that it can be carried out very rapidly and without problems, without having to carry out costly work at the spinning unit. The changing of the suction effect may be carried out via control valves or by changing the suction slots of the suction inserts facing the friction areas. These suction slots may be changed with respect to their position and/or their penetration cross-section.

In the case of another development, it is provided that for the correcting, the moving speed of at least one friction area is changed. Naturally, the moving speed of the friction areas has an influence on their friction effect. However, a correction via the moving speed is possible only if the friction areas are driven by means of independently controllable drives, for example by two individual motors.

After all types of corrections are made, it is advisable to make another examination of the friction effect or of the measured part so that the result of the correction can be checked. The examining of the friction effect may take place at periodic intervals, or also at certain operating conditions of the concerned spinning unit, for example, in the case of a yarn breakage or a spool change. In this case, the measuring in a particularly advantageous development is carried out while the machine is running, in which case the concerned spinning unit itself may be stopped. In this case, it is possible to drive the friction areas at a speed that is suitable for measuring, particularly by means of an auxiliary drive of the movable device. It is also possible to carry out the examination of the friction areas during the spinning operation. For example, via an opening, the corresponding measuring elements can be applied to the friction areas outside the range of the friction zone serving as the yarn forming point.

Other characteristics and advantages of the invention are found in the following description of the embodiments shown in the drawings.

DETAILED DESCRIPTION OF THE DRAWINGS

Figure 1:
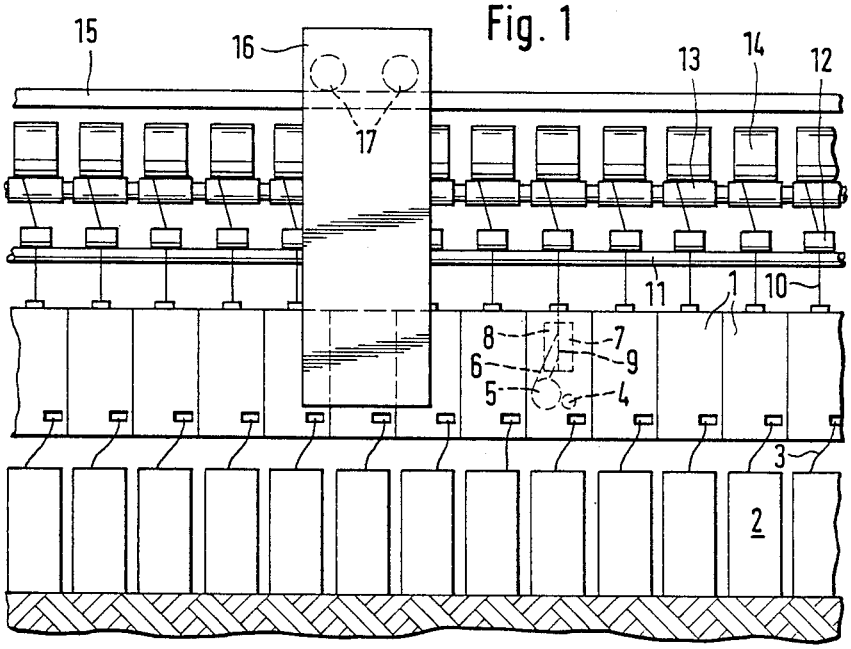
FIG. 1 is a front view of an open-end friction spinning machine having a plurality of spinning units and a movable device for carrying out servicing operations.

The open-end friction spinning machine shown in FIG. 1 contains a plurality of spinning units 1 arranged next to one another in a row in which a sliver 3 fed from a sliver can 2 is spun into a yarn 10. Each spinning unit 1 contains a feeding and opening device having a feeding roller 4 and an opening roller 5, by means of which, in a known way, the fed sliver 3 is opened up into individual fibers. These individual fibers are fed, via a fiber feeding duct 6, to the wedge-shaped gap 9 of two narrowly adjacent rollers 7 and 8 that serve as the friction zone and the yarn forming point. In the wedge-shaped gap 9, the fibers are twisted into a yarn 10 that is withdrawn, in longitudinal direction of the wedge-shaped gap 9, by means of a withdrawal device formed by a non-reversing driven lower cylinder 11 and a pressure roller 12 assigned to each spinning unit 1. Subsequently, the yarn 10 is wound onto a winding spool 14 that in each case is driven by a grooved drum 13. The individual grooved drums 13 are arranged on a joint driven shaft rotating through in longitudinal direction of the machine.

At the open-end friction spinning machine, moving rails 15 are mounted extending in longitudinal direction of the machine. An arrangement 16 can be moved on rails 15 by means of running wheels 17 that carry out servicing work. At least one of the running wheels 17 is driven. The arrangement 16, in a way that will be explained below, is equipped with means for examining the friction effect of the rollers 7 and 8 and with means for carrying out the possibly required corrections of the friction effect. In addition, the arrangement may also be equipped with means for carrying out an automatic cleaning of the rollers 7 and 8 and other areas, and/or equipped with devices for carrying out a start spinning process after a yarn breakage and/or equipped with devices for carrying-out a spool change.

Figure 2:
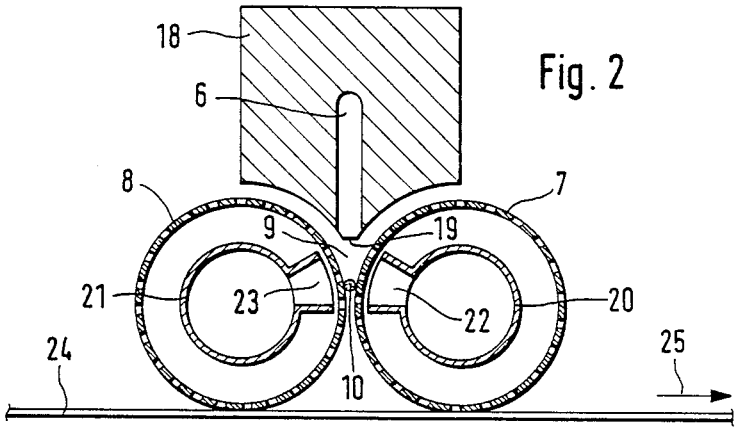
FIG. 2 is an enlarged cross-sectional view of a spinning unit of the open-end friction spinning machine of FIG. 1 with two rollers serving as the friction areas.

The rollers 7 and 8 of the spinning units 1 (FIG. 2) are developed as so-called suction rollers. They have a shell provided with a perforation in which suction tubes 20 and 21 are arranged that are connected to a vacuum source such as a fan, that is not shown. The suction tubes 20 and 21 are each provided with a longitudinal slot 22 and 23 that is aimed at the area of the wedge-shaped gap 9 and that extends essentially in longitudinal direction of the wedge-shaped gap 9. Via the longitudinal slots 22 and 23, an air flow in the area of the wedge-shaped gap 9, is sucked through the shells of the rollers 7 and 8. This suction air flow, on the one hand, has the purpose of holding the forming yarn 10 in the wedge-shaped gap 9, and, on the other hand, of generating an air flow in the fiber feeding duct 6 by means of which the transport of the fibers is at least supported. The fiber feeding duct 6 that is located in a partial housing 18, is provided with a slot-type mouth 19 extending in longitudinal direction of the wedge-shaped gap 9. The partial housing 18 covers the rollers 7 and 8 in the area of the wedge-shaped gap 9.

The rollers 7 and 8 are disposed directly on the suction tubes 20 and 21 by means of roller bearings, in a way that is not shown in detail. The rollers 7 and 8 are driven by a tangential belt 24 moving in the direction of the arrow 25 in longitudinal direction of the machine. The belt 24 drives the rollers 7 and 8 of all spinning units 1 of one side of the machine.

Figure 3:
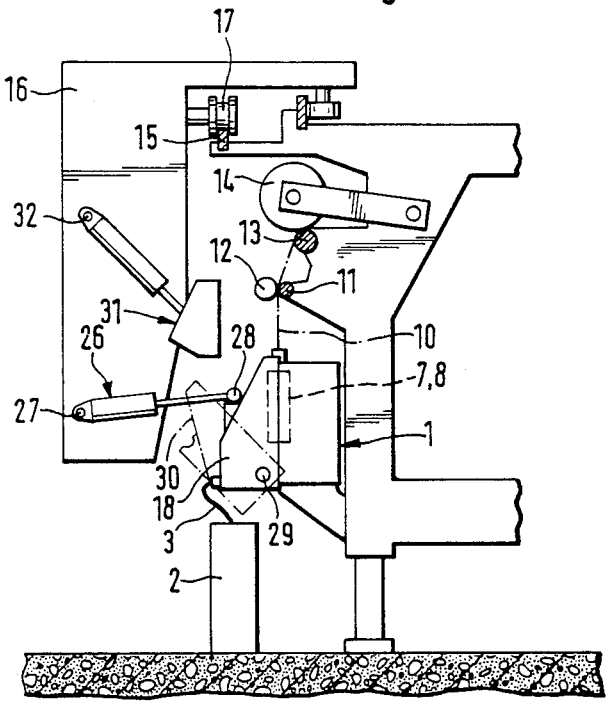
FIG. 3 is a sectional view through the friction spinning machine according to FIG. 1 with the movable device operating at one spinning unit.

The movable maintenance device 16 (FIG. 3) is equipped with an opening device 26 that is developed, for example, as a hydraulic or pneumatic press. The opening device 26 is pivotable around a shaft 27 and can be applied, by means of a grip part 28, to a correspondingly developed counterpart of the partial housing 18 of a spinning unit 1 in such a way that the partial housing 18 can be swivelled around a shaft 29 that is stationary at the spinning unit 1, into the dash-dotted servicing position 30. In the servicing position 30, the front sides of the rollers 7 and 8 as well as the wedge-shaped gap 9 are accessible for servicing purposes. The arrangement 16 also contains a measuring device 31 that is arranged on an application device that can be swivelled around a shaft 32 and is developed as a hydraulic of pneumatic press, for example. After the swivelling-away of the partial housing 18, the measuring device 31 can be applied to the rollers 7 and 8. The measuring device 31 is used for examining at least one part of the friction effect of the rollers 7 and 8 such as the surface structure and/or the coefficient of friction of the surfaces and/or the suction effect in the area of the rollers 7 and 8, for example.

Figure 4:
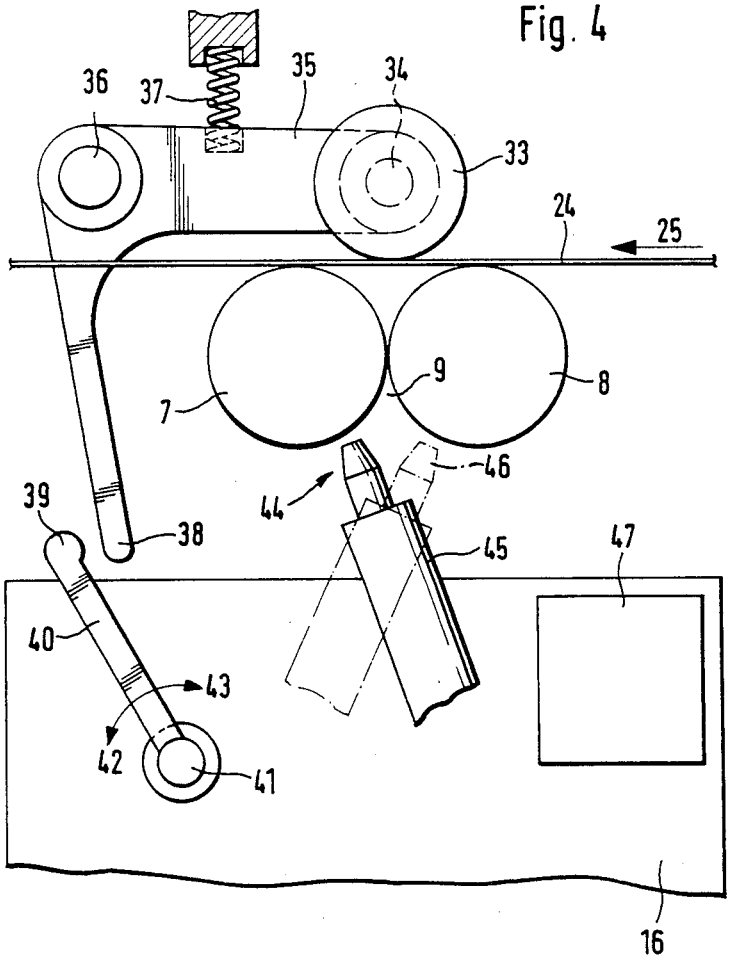
FIG. 4 is an enlarged sectional view through a spinning unit where the movable device is starting to operate at a spinning unit.

As shown in FIG. 4, the arrangement 16 is equipped with means for interrupting the drive of the rollers 7 and 8. The tangential belt 24 moving in the direction of the arrow 25 is stressed in the direction of the rollers 7 and 8, by means of a tension roller 33 located in the plane of the wedge-shaped gap. The tension roller 33 can be rotated freely around a shaft 34 that is disposed on a pivoted lever 35 that can be pivoted around a stationary shaft 36. The pivoted lever 35 is loaded by a pressure spring 37 in the direction of the tangential belt 24. At the pivoted lever 35, an operating arm 38 is mounted that projects toward the front to the operating side of the spinning unit 1. By means of the swivelling of the pivoted lever 35 via the operating arm 38 around the shaft 36, the tension roller 33 can be lifted off the tangential belt 24. The tangential belt 24 is guided by means of guide rollers that are not shown and are disposed on the side of the rollers 7 and 8 . The guiding takes place in such a way that the belt will then be detached from the rollers 7 and 8. The movable maintenance device 16 is equipped with a lever 40 that can be swivelled around a shaft 41 in the direction of the arrows 42 and 43 by means of a drive. The lever 40 can be applied to the operating arm 38 of the pivoted lever 35 by means of a pressure piece 39, so that the movable maintenance device 16 can interrupt the drive of the rollers 7 and 8, and if necessary, can temporarily turn it on again by a back-and-forth movement of the lever 40.

As also shown in FIG. 4, the arrangement is equipped with a sensor 44 that is part of the measuring device 31, and that can be moved out into the area of the shell surfaces of the rollers 7 and 8, via an adjustment drive 45 that is not shown in detail. In addition, the sensor 44, by means of a swivel drive, can be swivelled around a shaft that is parallel to the shafts of the rollers 7 and 8, in such a way that it is applied in each case to the shell surface of one of the rollers 7 and 8, i.e., either in the position shown by drawn-out lines or the position 46 shown by dash-dotted lines. In addition, it is provided that the adjustment drive 45 of the sensor 44 can be adjusted in axial direction of a generating line of the rollers 7 and 8 so that it can move along a larger range of the length of the rollers 7 and 8. By the switching-on and off of the drive of the rollers 7 and 8 via the lever 40, several points of the circumference of the rollers 7 and 8 can be examined with respect to the surface structure, also.

In the case of a preferred embodiment, the sensor 44 operates according to a scattered-light process, in which the scattering behavior of the rollers 7 and 8 is utilized for determining a parameter for the roughness of this surface. The surfaces to be tested are illuminated by means of an intensive infrared beam of rays. A part of the emitted rays is reflected, in which case the angular distribution of these rays is characteristic of the surface structure of the tested surface. By means of an optical system, via the intensity distribution of the reflected light, a function of the scattering angles can be determined so that a value is received on the surface structure of the rollers 7 and 8. As a rule, it is sufficient to determine the surface structures of both rollers 7 and 8 and compare them with one another.

The sensor 44 is connected to an evaluating device 47 that, via the received signals, compares the surface structures of the rollers 7 and 8 with one another, and thus the proportion of the friction effect that depends on this surface structure. In addition, the evaluating device 47 carries out a comparison with a desired value for the ratio between the two surface structures, in which case it is determined whether the two rollers 7 and 8 still have surface structures that make possible the spinning of a yarn 10 with the desired values.

Figure 5:
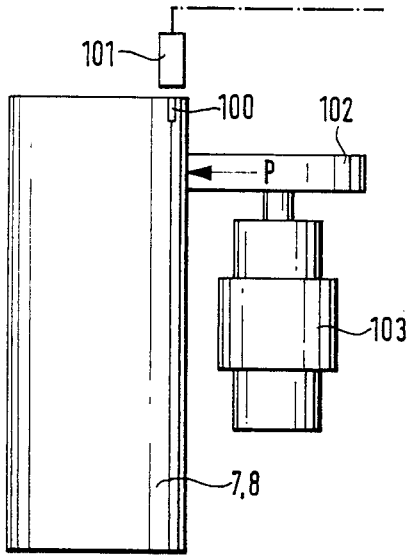
FIG. 5 is a side view of a device for the determination of a coefficient of friction at a roller by means of a slip measurement.

FIG. 5 shows measuring elements of a measuring device 31 of a movable maintenance device 16 by means of which a direct detection of the coefficient of friction of the surfaces of the rollers 7 and 8 is possible. With a defined application force P, a freely rotatable disk 102 is applied to the surfaces of the rollers 7 and 8. The disk 102 is connected to a tachometer (tachogenerator) 103 that detects the starting behavior of the disk 102. The speed of the rollers 7 and 8 is determined via a non-contact speed sensor 101 to which the moving indexes of the rollers 7 and 8 are assigned. The circumferential speed of the rollers 7 and 8 is determined via a pulse count. In an evaluating device that is not shown, the received measuring results are evaluated, whereby, via the slip of the starting of the disk 102, information is obtained on the coefficient of friction of the rollers 7 and 8. The disk 102, in a way that is not shown in detail, can also be adjusted in axial direction of the rollers 7 and 8 so that several measurements can be carried out from which the mean will then be taken.

Figure 6:
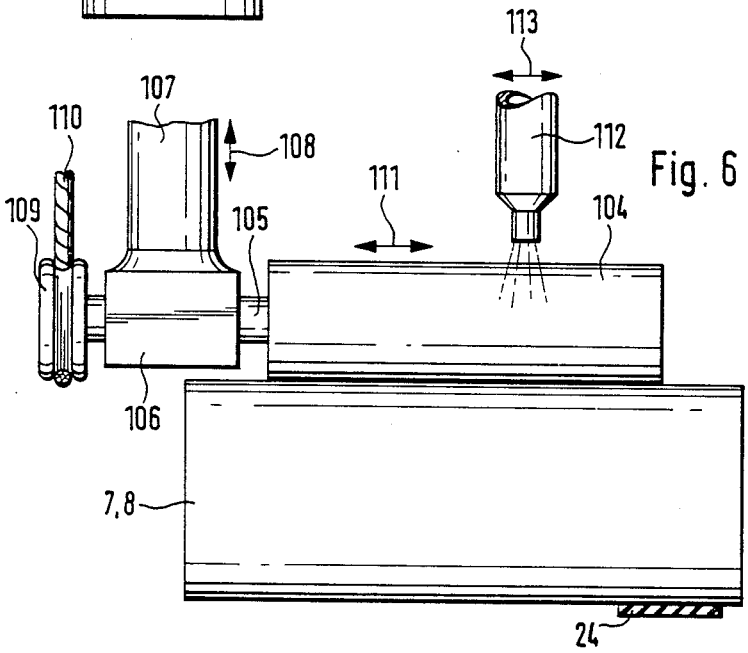
FIG. 6 is a side view of a movable device having a device for treating the surface of a roller serving as the friction area.

When inadmissible deviations are found in the ratio of the coefficients of friction of both rollers 7 and 8, the movable maintenance device 16 carries out a treatment of the surfaces of one or both rollers 7 and 8. In the embodiment shown in FIG. 6, the surfaces of the rollers 7 and 8 are aftertreated mechanically by means of a polishing roller 104. The polishing roller 104, by means of a shaft 105, is disposed in a bearing 106 of a holder 107 of the arrangement 16. The polishing roller can be moved in the direction of the double arrow 108, and can thus be applied to the shell areas of the rollers 7 and 8. The polishing roller 104 is driven by a driving motor that is not shown, via a driving disk 109 and a belt or a round cord 110. The holder 107 can also be moved in longitudinal direction of the rollers 7 and 8, corresponding to the double arrow 111, so that also the whole length of the rollers 7 and 8 can be treated by the polishing roller 104 that in axial direction is designed to be shorter than the rollers 7 and 8. A coating nozzle 112 is also assigned to the polishing roller 104, which can be adjusted in the direction of the double arrow 113 along a generating line parallel to the surface of the polishing roller 104. Naturally, also all other types of treatment of the surfaces of the rollers 7 and 8 are possible, for example, as discussed in the introduction to the specification.

Figure 7:
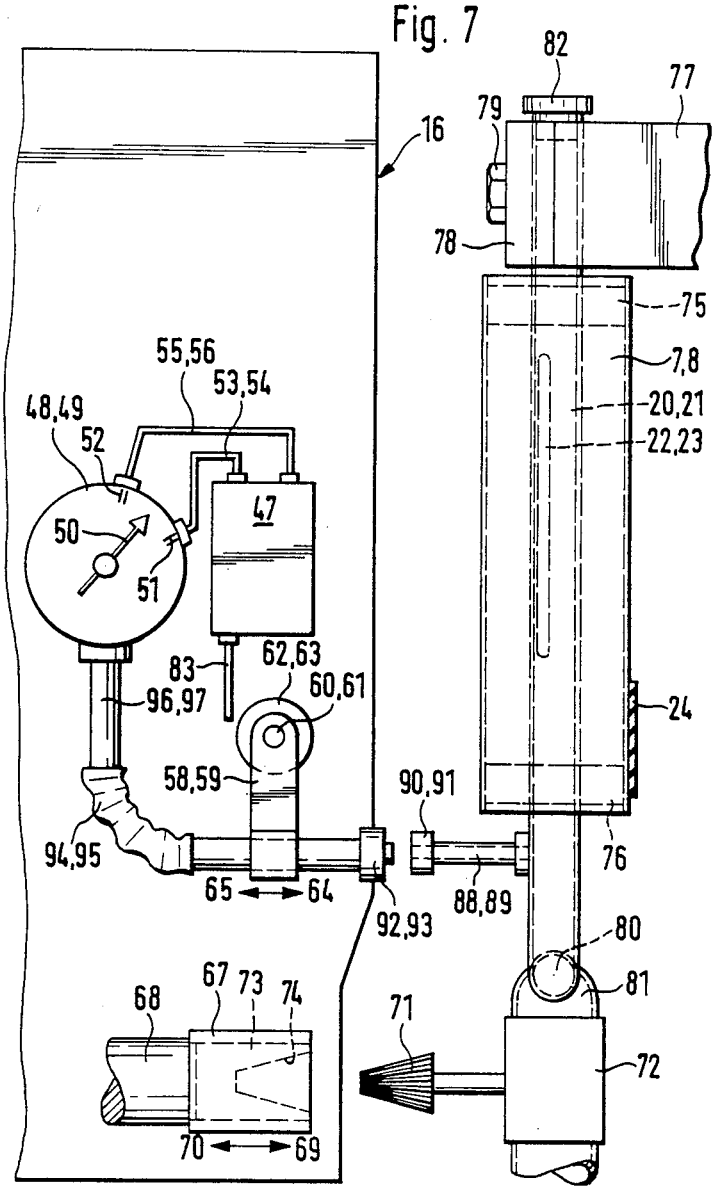
FIG. 7 is a sectional view of a spinning unit and a movable device which is equipped with devices for the testing and adjusting of the suction effect of the suction device.

As shown in FIG. 7, it is also possible to carry out a correction of the changed friction effects via the available air. The suction air flow that is generated by the suction devices 20, 22 and 21, 23 also has a considerable effect on the friction effect. In alternate embodiments not shown in the drawings, both rollers 7 and 8 need not be developed as suction rollers. In another embodiment, the roller 8 rotating out of the wedge-shaped gap 9, serving as the friction zone and the yarn forming point, is provided with a closed shell surface. In the shown embodiment, both rollers 7, 8 are constructed as suction rollers so that the devices of the spinning unit 1 and of the movable maintenance device 16 at least partly are provided with dual systems to accommodate both rollers.

In the embodiment according to FIG. 7, the rollers 7 and 8 are directly disposed on the suction tubes 20 and 21 by roller bearings 75 and 76. The suction tubes 20, 21 that on one side are closed by a stopper 82, are led out of the upper ends of the rollers 7 and 8 and are clamped fast in a holder 77 by a clamping plate 78 that is held by one or several screws 79. The other ends of the suction tubes 20 and 21, via a branching 80, are connected to a vacuum supply line 81 that is connected to a vacuum source in a way that is not shown in detail. In front of the branching 80, connecting sleeves 88 and 89 are mounted at the suction tubes 20 and 21 and are equipped with joining pieces 90 and 91 each having a closing element. Coupling pieces 92 and 93 of the movable maintenance device 16 can be applied to these joining pieces 90 and 91. When the coupling pieces 92 and 93 are applied in the direction of the arrow 64, the closing elements of the joining pieces 90 and 91 are opened, so that the vacuum existing in the suction tubes 20 and 21 is introduced into the measuring device 31 of the movable movable maintenance device 16. The coupling pieces 92 and 93 are held by holders 58 and 59 that can be swivelled around shafts 60 and 61 via an adjusting drive 62 and 63, in the direction of the arrows 64 and 65. The coupling pieces 92 and 93 are connected to inputs 96 and 97 of vacuum emitters 48 and 49 via a flexible line 94 and 95. In FIG. 7, for reasons of representation, the vacuum emitters 48 and 49 are shown as pressure gauges, each having an indicator 50. The vacuum emitters 48 and 49 are connected to an evaluating device 47. When the adjusted threshold values are exceeded, the limit switches 51 and 52 are reached, and the vacuum emitters 48 and 49 emit signals to the evaluating device 47 via lines 53, 54 and 55, 56.

The arrangement 16, shown in FIG. 7, is also equipped with an actuating element 67 that can be applied to a control element 71 of a control valve 72 in the direction of the arrows 69 and 70. The actuating element 67 has an interior cone 74 of a coupling part 73 that can be fitted onto a cone of the control element 71 in such a way that a force-locking or form-fitting connection is obtained. The actuating element 67 is arranged on a shaft 68 that can be sensitively adjusted in both rotating directions, by means of a servomotor that is not shown. The drive of the shaft 68 is controlled by the evaluating device 47 that is connected with the servomotor (not shown) of the shaft 68 via a line 83.

In another embodiment, two control valves corresponding to the control valve 72 are arranged in front of the branching 80 in the suction pipes 20 and 21, so that via actuating elements that correspondignly are available twice, the vacuum in the suction tubes 20 and 21 can be adjusted independently from one another.

Since a correction of the friction effect via the adjustment of the available air as a rule can be carried out more easily and rapidly, it will be preferred in practice that when an inadmissible deviation of the friction effect is determined, first a correction via the adjustment of the suction air flows is attempted. Therefore in an embodiment, only when this correction is not sufficient, will the treatment of the surfaces of the rollers 7 and 8 be advantageously carried out. Should this still not result in the desired conditions, the spinning unit 1 is stopped by the movable maintenance device 16 and, if necessary, also marked in such a way that it is not started and set up for an automatic startspinning process. It can only be started after the required corrections are carried out by an operator or another automatic servicing device.

In another embodiment of the invention, the rollers 7 and 8 of the spinning units 1 are each provided with their own drives so that the speeds of the rollers 7 and 8 can be adjusted individually at each spinning unit 1. In this case, for the correction of the friction effect, it can be provided that the speed of the rollers 7 and 8 is examined and is adjusted corresponding to the existing conditions. This adjusting may then take place as an alternative to the correction via the available air and/or the correction by treating the surfaces of the rollers 7 and 8.

In another embodiment of the invention, the measuring device 31 (FIG. 3) of the arrangement 16 is developed as a pneumatic testing head that is applied to the area of the wedge-shaped gap 9 of the rollers 7 and 8, and that tests the available air in the area of the wedge-shaped gap 9. This testing may take place by measuring the vacuum and/or the air volume and/or the flow rates in the area of the friction zone. Also in this case, the determined values are evaluated via an evaluating device, after which, if necessary, a correction for the friction effect is carried out as discussed.

Figure 8:
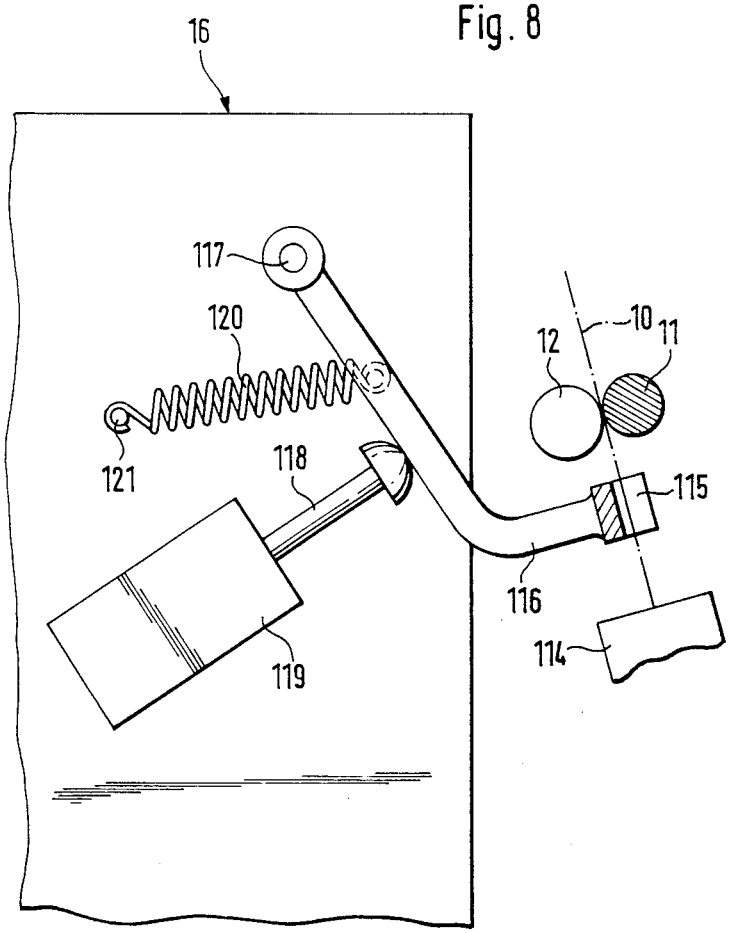
FIG. 8 is a partial view of a movable device having a measuring device that can be applied to the moving yarn of a spinning unit for examining the yarn diameter.

In another embodiment of the invention as shown in FIG. 8, by examining the yarn values, the friction values are examined indirectly. In this embodiment, the movable maintenance device 16 is provided with a measuring head 115 that is applied to the moving yarn 10 between a yarn guide 114 and the withdrawal device 11, 12. The measuring head 115 measures the diameter and/or the yarn twist and/or the yarn tension. Via an evaluating device, a conclusion can be drawn from these values that have a clear relationship to the friction effect and any possible existing deviations.

The measuring head 115 is arranged at a lever 116 that can be swivelled around a shaft 117 of the arrangement 16. The applying of the measuring head into the path of the moving yarn 10 takes place via a control member 119, such as an operating magnet. As shown in FIG. 8, the piston 118 is moved out. The return movement of the lever 116 takes place via a spring 120 that is coupled to it. The other end of the lever 116 is fixed to a bolt 121.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed:

1. A process for operating an open-end friction spinning machine having at least one spinning unit with each of said at least one spinning units including:

a yarn forming friction zone formed by at least two friction surfaces moving in opposite directions creating a yarn forming region and forming a wedge-shaped gap, wherein yarn is formed from fibers by means of a friction effect at said friction surfaces, said friction effect comprising at least one of suction effect and friction surface coefficient of friction effect, said friction surfaces including a first friction surface moving into said wedge-shaped gap and a second friction surface moving out of said wedge-shaped gap, said second friction surface over at least a part of the length of the wedge-shaped gap being designed for a friction effect that is higher than a friction effect of said first friction surface, feeding means for the feeding of fibers to the friction zone, yarn withdrawal means for withdrawing the forming yarn from the friction zone, said process comprising:

determining only the friction effect of said first friction surface relative to said second friction surface, said determining including separately monitoring the friction effect of each of said first and second friction surfaces, and generating a signal when said at least a part of the length of said second friction surface has a friction effect outside the range of 5% to 25% greater than a friction effect of said first friction surface.

2. Process as in claim 1, wherein said monitoring includes determining the friction effect existing in circumferential direction of the forming yarn and the friction effect existing in a withdrawal direction of the forming yarn.

3. Process as in claim 1, wherein said monitoring includes determining a part of the friction effect by an examination of the surface structure of the friction surfaces.

4. Process as in claims 1, wherein said monitoring includes determining a part of the friction effect by an examination of the coefficient of friction at the surfaces of the friction surfaces.

5. Process as in claim 1, wherein each spinning unit includes suction means for applying suction forces to the friction zone, said monitoring including determining a part of the friction effect by examining the suction effect of the suction means.

6. Process as in claim 1, wherein said monitoring includes determining the friction effect by examining the spun yarn.

7. Process as in claim 1, wherein said monitoring includes determining the friction effect by movable monitoring means being movable along the spinning machine and being applicable to the individual spinning units.

8. Process as in claim 1, wherein said monitoring includes displaying the determined values to an operator.

9. Process as in claim 1, further including correcting at least a part of the friction effect of the friction areas in the case of a determined deviation of the friction effect exceeding an admissible value, said correcting being a function of the deviation.

10. Process as in claim 1, wherein said correcting of the friction effect includes treating at least one friction surface.

11. Process as in claim 11, wherein said correcting includes adjusting a spinning parameter influencing the friction effect.

12. Process as in claim 11, wherein each spinning unit includes suction means for applying suction forces to the friction zone, said correcting includes changing the suction effect of the suction means onto at least one friction surface.

13. Process as in claim 11, wherein said correcting includes changing the moving speed of at least one friction surface.

14. Open-end friction spinning machine having at least one spinning unit, each of said at least one spinning units comprising:

a friction zone formed by at least two friction surfaces moving in opposite directions creating a yarn forming region and forming a wedge-shaped gap, wherein yarn is formed from fibers by means of a friction effect at said friction surfaces, said friction effect comprising at least one of suction effect and friction surface coefficient of friction effect, said friction surfaces including a first friction surface moving into said wedge-shaped gap and a second friction surface moving out of said wedge-shaped gap, said second friction surface over at least a part of the length of the wedge-shaped gap being designed for a friction effect that is higher than a friction effect of said first friction surface, feeding means for the feeding of fibers to the friction zone, suction means for applying suction forces to the friction zone, yarn withdrawal means for withdrawing the forming yarn from the friction zone;

determining means for determining only the friction effect of said first friction surface relative to said second friction surface, said determining means including monitoring means for separately monitoring the friction effect of each of said first and second friction surfaces, and signal generating means for generating a signal when said at least a part of the length of said second friction surface has a friction effect outside the range of 5% to 25% greater than a friction effect of said first friction surface.

15. Apparatus as in claim 14, further including correcting means for correcting at least a part of the friction effect of the friction areas in the case of a determined deviation of the friction effect exceeding an admissible value, said correcting means correcting the friction effect as a function of the deviation.

16. Apparatus as in claim 15, wherein said correcting means adjusts a spinning parameter influencing the friction effect.

* * * * *